US006759368B2

(12) United States Patent
Lelental et al.

(10) Patent No.: US 6,759,368 B2
(45) Date of Patent: Jul. 6, 2004

(54) THERMALLY IMAGEABLE ELEMENTS AND PROCESSES FOR THEIR USE

(75) Inventors: Mark Lelental, Rochester, NY (US); Henry J. Gysling, Rochester, NY (US); David F. Jennings, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/610,415

(22) Filed: Jun. 30, 2003

(65) Prior Publication Data

US 2004/0092398 A1 May 13, 2004

Related U.S. Application Data

(60) Division of application No. 10/210,762, filed on Aug. 1, 2002, now Pat. No. 6,635,601, which is a division of application No. 09/536,181, filed on Mar. 27, 2000, now Pat. No. 6,509,296, which is a continuation-in-part of application No. 09/031,860, filed on Feb. 27, 1998, now abandoned.

(51) Int. Cl.[7] ..... B41M 5/20

(52) U.S. Cl. ..... 503/202; 503/201; 503/208; 503/215; 503/226

(58) Field of Search ..... 503/201, 202, 503/208, 215, 226

(56) References Cited

U.S. PATENT DOCUMENTS

| | | | | |
|---|---|---|---|---|
| 1,939,232 | A | | 12/1933 | Sheppard et al. |
| 3,700,448 | A | | 10/1972 | Hillson et al. |
| 3,719,490 | A | | 3/1973 | Yudelson et al. |
| 3,773,512 | A | | 11/1973 | Poot et al. |
| 3,935,013 | A | | 1/1976 | Lelental |
| 4,012,292 | A | * | 3/1977 | Fujiwara et al. ..... 205/56 |
| 4,042,392 | A | | 8/1977 | Gysling et al. |
| 4,046,569 | A | | 9/1977 | Gysling et al. |
| 4,097,281 | A | | 6/1978 | Gardner et al. |
| 4,152,155 | A | | 5/1979 | Lelental et al. |
| 4,273,860 | A | | 6/1981 | Adin |
| 4,292,399 | A | | 9/1981 | Adin |
| 4,294,912 | A | | 10/1981 | Adin et al. |
| 4,308,341 | A | | 12/1981 | DoMinh |
| 4,318,977 | A | | 3/1982 | DoMinh |
| 4,433,037 | A | | 2/1984 | DoMinh |
| 4,621,271 | A | | 11/1986 | Brownstein |
| 4,727,008 | A | | 2/1988 | Lelental et al. |
| 5,464,738 | A | | 11/1995 | Lynch et al. |
| 5,587,350 | A | | 12/1996 | Horsten et al. |
| 5,618,773 | A | | 4/1997 | Bailey et al. |
| 5,629,130 | A | | 5/1997 | Leenders et al. |
| 5,741,592 | A | | 4/1998 | Lewis et al. |

FOREIGN PATENT DOCUMENTS

| | | |
|---|---|---|
| EP | 0 806 320 A1 | 11/1997 |
| GB | 1405628 | 9/1975 |

* cited by examiner

*Primary Examiner*—B. Hamilton Hess
(74) *Attorney, Agent, or Firm*—J. Lanny Tucker

(57) ABSTRACT

A thermally imageable element can be imaged using heat alone without the need for photosensitivity or post-imaging processing. The element contains image-forming chemistry that comprises i) image precursor chemistry and ii) a catalyst or a catalyst precursor that upon imagewise heating is capable of promoting thermally induced image formation with the image precursor chemistry. The image-forming chemistry i) and ii) components are in reactive association and uniformly dispersed or dissolved within a binder in one or more layers of the element. Thus, the element is capable of being thermally addressed to provide a visible image as a result of thermally induced catalytic transformation of the image-forming chemistry.

17 Claims, 1 Drawing Sheet

THERMALLY IMAGEABLE ELEMENTS AND PROCESSES FOR THEIR USE

CROSS-REFERENCE TO RELATED APPLICATION

This is a Divisional of U.S. Ser. No. 10/210,762 filed Aug. 1, 2002, now U.S. Pat. No. 6,635,601, which is a Divisional of U.S. Ser. No. 09/536,181 filed Mar. 27, 2000, now U.S. Pat. No. 6,509,296, which is a Continuation-In-Part of U.S. Ser. No. 09/031,860 filed Feb. 27, 1998, now abandoned.

FIELD OF THE INVENTION

The present invention relates to thermally imageable elements for use in direct thermal imaging systems. Imaging methods of the invention utilize thermally induced catalytic transformation of image-forming chemistry within tile elements to provide an image without the need for photosensitivity (that is the incorporation of any photosensitive component).

BACKGROUND OF THE INVENTION

Thermal imaging is a process in which images are recorded by the use of imagewise modulated thermal energy. A review of thermal imaging is provided, for example, in *Imaging Systems* by Jacobson and Jacobson (Focal Press, 1976). In general, there are two types of thermal recording systems.

In one system the image is generated by thermally activated transfer of a heat absorbing material from a donor element to a receiver element, while the other general process involves thermal activation using chemical or physical modification of components of a single imaging element. Processes of the first type include thermal dye transfer systems in which a dye is thermally transferred from one element (the donor sheet) to a second layer (the receiver sheet) as described, for-example in U.S. Pat. No. 4,621,271 (Brownstein) and U.S. Pat. No. 5,618,773 (Bailey et al). Such systems, while providing color images of high quality, suffer from the disadvantage of requiring two sheets and the associated printer hardware for such a physical transfer of dye between two sheets.

Systems of the second type are those in which the image is formed in the element that is imagewise exposed using heat. The discussion that follows relates to systems of the second type.

Thermal energy can be delivered in a number of ways, for example, by direct thermal contact or by absorption of electromagnetic radiation. Examples of useful radiant energy sources include infrared lasers, thermal print heads, and electron beam devices. Modulation of thermal energy can be by intensity or time or both. For example, a thermal print head comprising microscopic resistor elements is fed pulses of electrical energy that are converted into heat by the Joule heating effect. In a particularly useful embodiment, the pulses are of fixed voltage and duration and the thermal energy delivered is then controlled by the number of such pulses sent to the print head. Radiant energy can also be modulated directly by means of the energy source, for example the voltage applied to a solid state laser Direct imaging by thermally induced chemical change in a recording element usually involves an irreversible chemical reaction which takes place very rapidly at elevated temperatures (for example, above 100° C.). At room temperature the reaction rate is orders of magnitude slower such that, effectively, the material is stable at the latter temperature. A particularly useful "dry silver" direct thermal imaging element uses an organic silver salt in combination with a reducing agent: In this system the chemical change induced by the application of thermal energy is the reduction of the transparent silver salt to a metallic silver image by the reducing agent incorporated in the coating formulation. Such thermographic elements, after imagewise thermal exposure, provide a final image without the need for any post-exposure solution processing.

In addition to the dry silver imaging elements, non-silver dry photothermographic imaging systems are also known. For example, it is known to produce tellurium images by disproportionation of tellurium dihalides, as illustrated U.S. Pat. No. 3,700,448 (Hillson et al). The images are formed in the presence of a processing liquid that promotes the disproportionation amplification reaction in the presence of catalytic amounts of photogenerated elemental tellurium ($Te^0$). The tellurium dihalides, however, are dark in color causing poor image discrimination. Further, the tellurium dihalides are typically unstable in air and undergo light induced decomposition only when moistened with an organic solvent. Accordingly, the tellurium dihalides do not satisfy the needs of dry processing.

It is also known that certain tellurium (IV) compounds wherein the tellurium is bonded directly to one or more carbon atoms can be used in photothermographic imaging. In GB-A-1,405,628 certain tellurium compounds, wherein the tellurium is bonded directly to a carbon atom, are described as useful image forming materials in thermally developed systems. The process using these organotellurium (IV) compounds to form a tellurium image is a unit quantum photoreduction, that is the $Te^0$ is formed in a stoichiometric reaction by reduction of the Te(IV) compound by the photogenerated organic reducing agent. This process lacks any amplification and is, therefore, inherently slow in speed and, as a result, limited in usefulness.

An amplification step is an important factor in imaging systems having high speed. In such processes and elements, typically a redox reaction is catalyzed by a material that is generated in the exposure step. In the highest imaging speed materials, conventional wet processed silver halide photographic materials, high speeds are attributable to the following amplification process: exposure of photographic silver halide to light results in formation of small silver nuclei on the silver halide grain surfaces that catalyze the further reduction of silver halide in these exposed grains in a subsequent solution development employing a developing agent (a reducing agent) to give elemental silver in a high gain catalytic reaction.

Imaging materials have been described wherein a substance capable of darkening when heated is employed in the presence of a catalyst, such as described in U.S. Pat. No. 1,939,232 (Sheppard et al). This imaging material employs a compound such as silver oxalate to form an image and a compound such as tellurium dichloride as a catalyst. Thus, this system is quite different from the conventional photothermographic systems described above that rely on silver or a non-silver material, such as $Te^0$ to provide image density after an imagewise light exposure to produce a developable latent image, and a subsequent uniform heating of the entire imaged clement to produce the final visible image.

Materials are also known in the imaging art in which metal nuclei are used to initiate physical development processes. For example, processes in which such catalytic metal nuclei are generated by a light exposure step and subsequently amplified by solution physical are well know in the art, as illustrated in U.S. Pat. No. 3,719,490 (Yudelson et al).

Thermally processed non-silver photographic processes that incorporate redox amplification have also been described in the art. For example, imaging elements containing a photosensitive catalyst precursor, along with a physical development element comprising a Te(II) or Te(IV) compound, incorporated in a polymeric matrix with an organic reducing agent, are exposed to a suitable light source and then thermally developed to give a dense, black image of elemental tellurium. Such elements are referred to as "photothermographic" that is an initial exposure step produces nuclei which act as a catalyst for the chemical reduction of the Te(II) or Te(IV) compound to $Te^0$ by an organic reductant upon subsequent thermal development of the exposed clement. Thus; a small amount of invisible photoproduct (the "latent image") is converted into a high density image by utilizing its catalytic property to initiate a redox reaction with a high amplification factor. Thermally processed photothermographic elements of this type have been described in U.S. Pat. No. 4,097,281 (Gardner et al) and U.S. Pat. No. 4,152,155 (Lelental et al).

In contrast to the above imaging processes involving light exposures, there has been a continuing need to provide improved thermographic compositions and processes in which an element can be thermally addressed to give directly an image without the need for an initial light exposure step. The use of so-called dry silver elements for this purpose is well known in the art. Such elements comprise a redox couple of a light stable silver salt, such as silver behenate, and an organic reducing agent incorporated in a polymeric matrix with various coating addenda, as described, for example, in U.S. Pat. No. 5,587,350 (Horsten et al) and U.S. Pat. No. 5,629,130 (Leenders et al).

Such thermographic silver systems generally incorporate a high coverage of the silver salt to produce a useful image density (typically from 40 to 85 mg/dm$^2$). In addition to the cost associated with the use of such silver compounds, these systems require a time consuming and expensive manufacturing process involving dispersing of the water insoluble silver behenate particles to give a material which can produce good quality coatings. Therefore, a need exists for silver or non-silver thermographic systems employing a catalytic thermal development process with a high level of amplification and lower energy requirements. In addition, a need exists for system elements employing an image forming composition that can be readily dissolved in a polymer solution and conveniently coated on a suitable support, thus reducing the cost and inconveniences of manufacture noted above for conventional colloidal dispersion-based systems.

SUMMARY OF THE INVENTION

In its broadest sense, the present invention provides a thermally imageable element comprising a support having thereon one or more layers, the element further comprising:

image-forming chemistry that comprises i) image precursor chemistry, and ii) a catalyst or catalyst precursor that upon imagewise heating is capable of promoting thermally induced image formation with the image precursor chemistry, the i) and ii) components being in reactive association and uniformly dispersed or dissolved within a binder in the one or more layers, the element capable of being thermally addressed to provide a visible image as a result of thermally induced catalytic transformation of the image-forming chemistry.

In addition, this invention provides a process of forming an image comprising imagewise thermally addressing the thermally imageable element described above at a temperature of at least 75° C.

In a preferred embodiment, this invention is directed to a non-photosensitive thermally addressable imaging element comprised of a support having thereon in reactive association:

i) an oxidation- reduction image-forming combination (i e. image precursor chemistry) comprising:

a) a reducing agent, and b) an oxidizing agent to produce an elemental metal, metal compound or dye on reaction with the reducing agent, the reducing agent and oxidizing agent being separate compounds or components of the same compound, ii) a catalyst or catalyst precursor capable of promoting the oxidation-reduction reaction of a) and b) on heating, and iii) a binder, wherein the oxidizing agent is comprised of a leuco dye or a selenium, tellurium, bismuth, copper or nickel compound that is a In still another embodiment, this invention is directed to a process of forming an image in the non-photosensitive thermally addressable imaging element described above comprising imagewise thermally addressing the element to a temperature of at least 80° C.

The present invention provides a means for using a catalytic transformation during thermal imaging of the thermally addressable elements. In all embodiments, the image-forming chemistry (components i and ii) needed for providing an image is uniformly dispersed or dissolved within one or more layers of the element as opposed to being disposed in a predetermined pattern.

The present invention offers the capability of avoiding the disadvantages of the dry thermographic imaging systems discussed above. Specifically, the present invention does not require photosensitive silver compounds for imaging and also achieves image amplification. The elements of the invention can be dissolved in and coated from a polymer solution, and are thus more convenient to manufacture than the non-catalytic silver behenate type dry silver thermographic systems that are commonly used.

In the preferred embodiments, the catalytic transformation promotes an oxidation-reduction reaction in the uniformly dispersed image precursor chemistry to provide the image. This is preferably accomplished in a single step wherein a uniformly dispersed catalyst initiates the oxidation-reduction reaction. Alternatively, a uniformly dispersed, thermally-sensitive "catalyst precursor" can be transformed during application of thermal energy into the catalyst that then induces the desired oxidation-reduction reaction.

In still other embodiments, the uniformly dispersed catalyst or catalyst precursor can induce other chemical or physical changes of the image to precursor chemistry to provide the desired image. For example, in response to thermal energy, the catalyst or catalyst precursor can react with the image precursor chemistry to cause a change in pH or hydrophilicity or to bring about polymerization or isomerization reactions. Those changes in turn provide an image.

Still again, application of thermal energy can cause a physical change of some type, such as the breaking of barriers that normally keep the image precursor chemistry separated from the catalyst or catalyst precursor prior to imaging; For example, either the image precursor chemistry or catalyst (or catalyst precursor) can be encapsulated, and the vesicular or microcapsular walls can be broken during heating to allow the desired chemical reactions to occur. In still another embodiment, heating can allow intermixing of the components of the image-forming chemistry that were separated by a barrier layer prior to thermal imaging. Other means of using these features of the catalytic image-forming chemistry of this invention would be readily apparent to one skilled in the art in view of the teaching and references noted below.

All of these various embodiments demonstrate the advantages of the present invention wherein catalytic thermal imaging can be achieved with lowered activation energies, compared to prior art non-catalytic thermal chemical systems such as thermographic silver systems. The incorporation of such a catalytic imaging forming process allows imaging in shorter imaging times and/or at lower temperatures compared to conventional thermal imaging (for example non-catalytic systems). Moreover, they provide a variety of means for achieving the desired thermally-induced images from a variety of imaging devices and systems, thereby providing greater flexibility in thermal imaging for the industry. In addition, thermal addressing the elements of this invention can be achieved either with direct thermal contact such as by use of a thermal print head, or by irradiation such as by addressing the imaging element selectively using an infrared laser.

Lastly, exposure to actinic radiation such as visible or UV light is not required for imaging as is the case in some thermal "development" systems for example as described in U.S. Pat. No. 4,152,155 of Lelental et al. The noted patent describes materials that are thermally developed after a separate step for latent image formation. In contrast, the materials of the present invention are thermally imaged (using thermal catalysis) and developed in a single step. Thus, the present invention requires no pre- or post-treatment steps besides the single thermal imaging step.

DESCRIPTION OF PREFERRED EMBODIMENTS

Figure 1:
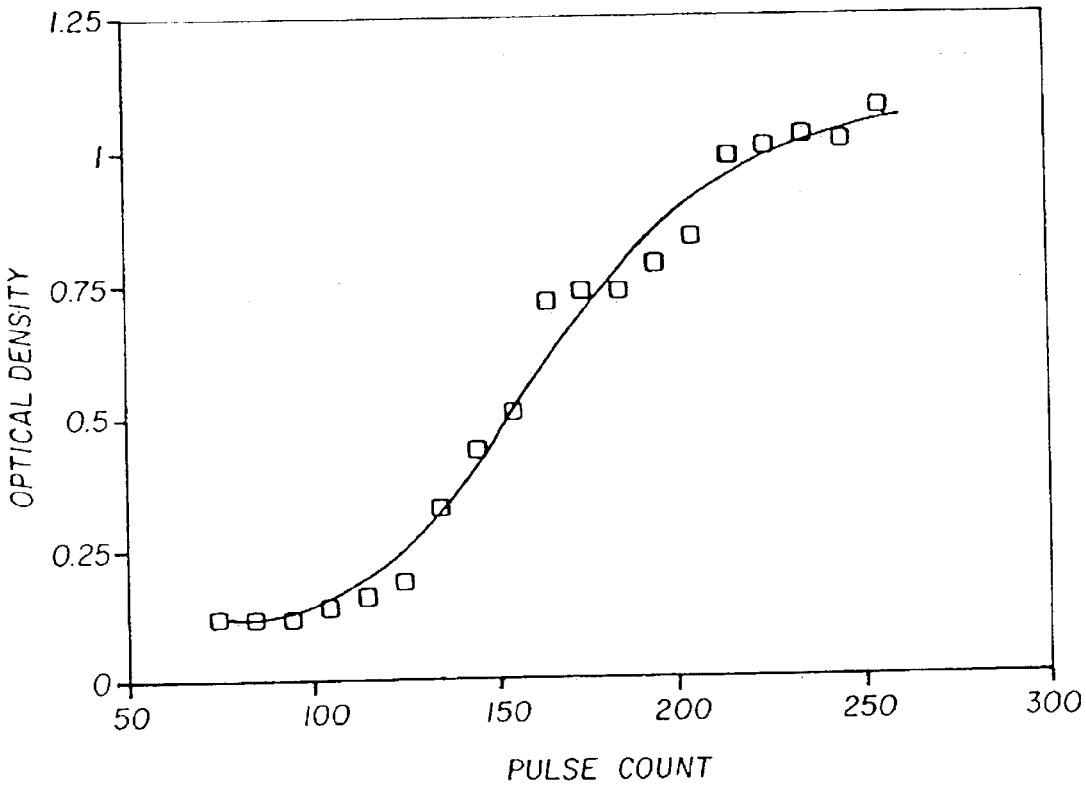
FIG. 1 is a graphical plot of optical density versus pulse count, the number of thermal pulses applied to the pixel area(s) at which the density measurement is taken. These data are discussed in the Example presented below.

The thermally imageable elements of this invention comprise image-forming chemistry that is uniformly dispersed or dissolved in one or more layers. The various components of the image-forming chemistry can be in the same or different layers as long as the components are in "reactive association". By "reactive association" is meant that the image precursor chemistry and the catalyst (or catalyst precursor) are in a location within the element with respect to each other, whereby upon thermally addressing the element, they can react with each other in a predetermined fashion. Preferably, the components of the image-forming chemistry are in the same layer or in two or more adjacent (and contiguous) layers of the element. In addition, the preferred elements of this invention are non-photosensitive, meaning that they are not imaged using exposure to actinic radiation.

Image Precursor Chemistry

The image-forming chemistry required for the elements of this invention have two essential components: image precursor chemistry and a catalyst or catalyst precursor. Each of these components can also have more than one component, as will be evident from the following discussion.

The "image precursor" chemistry includes one or more components that can be transformed or reacted in some manner in response to the catalytic behavior of the catalyst to provide a visible or inked (inking provides image discrimination) image. There are a number of types of image precursor chemistries that can be used in the practice of this invention, and a number of such chemistries are described in more detail below. The "catalyst (or catalyst precursor)" is a compound or combination of compounds that is sensitive to the thermal energy applied during imaging and transforms or interacts with the image precursor chemistry to reduce the activation energy for the image forming reactions.

There are a variety of possible image-forming chemistries that can be used in the practice of this invention. While a number of such chemistries are described below in relation to certain embodiments of the thermally imageable elements, it would be understood that a skilled worker in the art would readily perceive of other useful image-forming chemistries that would be within the scope of the present invention.

Polymerization Image-forming Chemistry

In one embodiment of this invention, a polymerizable monomer or mixture of monomers (such as ethylenically unsaturated polymerizable monomers) can serve as the image precursor chemistry in the thermally imageable element The monomer(s) are polymerized upon reaction during imaging in the presence of an appropriate polymerization catalyst(s). The polymerized monomer can provide a visible image in a number of ways, for example if the monomer(s) is colorless and the polymer is colored, or if the monomer(s) change color upon polymerization. In another instance, the polymer formed during imaging can act as a barrier to prevent diffusion of image-forming materials while such materials are allowed to move through the element in non-imaged areas.

Conversely, a polymer barrier layer could undergo depolymerization under the influence of the catalyst in the thermally addressed areas to allow diffusion of the components of the image forming chemistry in the thermally addressed areas, while the intact polymer would remain a barrier in the non-imaged areas.

Examples of monomers useful in this fashion include olefins such as those described in France et al, *J. Chem. Educ.* 76, 661–665(1999): *Ring-Opening Metathesis Polymerization with a Well-Defined Ruthenium Carbene Complex*, U.S. Pat. No. 5,880,241(Brookhart et al), WO 98/47934 (Feldman et al), and Robson et al, *Macromolecules*, 32, 6371–6373(1999), all incorporated herein by reference.

Useful catalysts would be readily apparent to a skilled worker in the art, and include, for example, transition metal metallocene type catalysts, such as those described in Brintzinger et al, *Angew. Chem.*, Int. Edit. Eng., 34, 1143–1170 (1995). Other useful polymerization catalysts include various transition metal coordination complexes such as those described in the above references, as well as in Matsui et al, *Chem. Lett.*, 1263(1999), and Britovsek et al, *Chem. Commun.*, 849 (1998). Other monomer/catalyst combinations are also possible, as would be known to those skilled in the art. In the preferred embodiment for the use of such catalytic polymerization reactions in the present invention, the catalyst is incorporated in microcapsules that are uniformly distributed, along with the monomer, in the polymeric matrix of the imaging element. Upon imagewise thermally addressing such an element, the microencapsuled catalyst is released and initiates the polymerization reaction.

Molecular Physical Developer Image-forming Chemistry

Still another embodiment of this invention can be designed by using certain metal complexes as molecular physical developers as part of the image-precursor chemistry. Such metal complexes comprise certain main group or transition metal ions that act as oxidizing agents, incorporated in coordination compounds that contain complexing ligands that act as a reducing agent at elevated temperatures (that is, during thermal imaging). Such metal complexes may include more than one type of complexing ligand including a ligand that stabilizes the molecule before imaging. Examples of such useful molecular physical developers include, but are not limited to, metalloboranes such as $Cu(PPh_3)_2BH_4$, $Cu\{P(OPh)_3\}_2B_3H_8$, $Ag(PPh_3)_2BH_4$ and $Mn(CO)_5B_3H_8$ as well as those known in the art such as described in Greenwood et al, *Chem. Soc Rev.*, 3, 231–271 (1974), Greenwood, *Pure Appl. Chem*, 55, 1415–30 (1983), U.S. Pat. No. 3,450,733 (Klanberg), and Meina et al, *J Chem. Soc.* (*Daltton Trans.*), 1903–1907 (1985), and $Cu(PPh_3)_2(B_9H_{13}X)$ (wherein X is H, NCS, NCSe, $NCBPh_3$, $NCBH_3$, or $NCBH_2NCBH_3$). Other useful molecular physical developers are metal xanthates such as $Te(S_2COR)_2$ wherein R can be a substituted or unsubstituted alkyl or aryl group and those described in the art such as Rao, *Xanthates and Related Compounds*, Dekker, N.Y., 1971 and Pandey et al, *Thermochimica Acta*, 96, 155–167 (1885). Still other useful molecular physical developers are metal complexes having the formula $ML_4$ wherein L is a 1,1-dithio ligand, M is a suitable metal ion (such as Te, Se, Cu, Cr, Mn, Co, Fe, Ni, Ag or Bi), and n is an integer of 1 to 4.

Examples of such useful metal complexes include, but are not limited to, dithiophosphinates such as $M(S_2P(R)_2)_2$ wherein M is preferably selenium, tellurium, copper or nickel, dithiophosphates such as $M(S_2P(OR)_2)_2$ wherein M is preferably copper, nickel, selenium or tellurium, and dithiocarbamates such as $M(S_2CN(R)_2)_2$ wherein M is preferably copper, nickel, selenium or tellurium and those well known in the art such as described in Thorn et al, *The Dithiocarbamates and Related Compounds*, Elsevier, Amsterdam, 1962).

Particularly useful molecular physical developers include the metalloboranes, metal xanthates and metal dithiocarbamates.

These molecular physical developers are used in combination with a metal nuclei catalyst (or a catalyst precursor) as described below. More details of molecular physical developers are provided for example in Gysling et al, *J. Photogr. Sci.*, 30, 55, 1982 and U.S. Pat. No. 4,188,218 (Gysling) that describes metal xanthates such as tellurium xanthates, and U.S. Pat. No. 3,505,093 (Schultz) that describes metalloboranes, these references incorporated herein by reference.

Oxidation-reduction Image-forming Chemistry

The preferred image-forming chemistries useful in the practice of this invention are based on oxidation-reduction systems. Several of such chemistries are now described in more detail.

Co(III) Systems:

There are a number of known Co(III) imaging systems can be utilized in the practice of this invention.

In one type of imaging system, Co(III) ligand compounds can be reduced in the presence of a reducing agent (such as those described below for the tellurium imaging systems). A Lewis base, such as ammonium or organic amine (such as diethylamine, ethylenediamine and others readily apparent lo one skilled: in the art), can act as the catalyst for this imaging system. Further details of this imaging system are provided for example in Lelental et al, *J. Photogr. Sci.*, 36(5), 158–66 and 167–76, 1988.

In a second Co(III) imaging system, a Co(III) ligand compound is reacted with a Lewis base in which the Lewis base is exchanged with the ligand to form a more unstable Co(III)Lewis base compound that is readily reduced to a Co(II) compound from which the Lewis base is released. Co(II) acts as the catalyst in these systems. For example, $[Co(NH_3)_6]^{3+}[Co(\text{ethylenediamine})_3]^{3+}$ and related Co(III) complexes can be used as image precursor chemistry to undergo catalytic ligand exchange and eventually provide Co(II) compounds. Ammonia or other amines are also released during this reaction can be used to provide image formation, for example to form a dye from a pH-sensitive dye precursor, activate a pH-sensitive reducing agent that can then be used in a variety of physical development systems. The catalysts useful for such,image-forming chemistries are Lewis bases and include for example, ammonia and organic amines such as diethylamine, diethyleneamine, ethylenediamine and others readily apparent to one skilled in the art. Further details of such imaging chemistry can be obtained for example in U.S. Pat. No. 4,727,008 (Lelental et al), WO 90/07730 (DoMinh), U.S. Pat. No. 4,433,037 (DoMinh), U.S. Pat. No. 4,308,341 (DoMinh), U.S. Pat. No. 4,318,977 (DoMinh), U.S. Pat. No. 4,294,912 (Adin et al). U.S. Pat. No. 4,292,399 (Adin), U.S. Pat. No. 4,273,860 (Adin) and DoMinh, *Research on Chemical Intermediates*, 12, 251–262 (1989), all incorporated herein by reference.

Silver Imaging Systems:

An image-forming chemistry can also be composed of a non-photosensitive silver (I) compounds the oxidizing agent in combination with a reducing agent, and a metal nuclei catalyst (or catalyst precursor) as described below. Such silver (I) compounds are well known in the art for use in thermographic and photothermographic imaging materials as non-photosensitive reducible silver sources. They include, but are not limited to, silver salts of thiones, silver salts of triazoles and tetrazoles, silver salts of imidazoles, and silver salts of organic acids (fatty carboxylic acid containing 10 to 30 carbon atoms), silver salts of compounds containing mercapto or thione groups and derivatives (such as salts of mercaptotriazoles, mercaptobenzimidazoles and thioglycolic acids), silver salts of compounds containing an imino group (such as salts of benzotriazoles and imidazoles), silver salts of acetylenes, and mixtures of any of these silver salts. There are hundreds of publications describing such silver complexes, including U.S. Pat. No. 5,939,249 (Zou) and references cited therein, all incorporated herein by reference. Compounds which are useful silver salt oxidizing agents include, but are not limited to, silver behenate, silver stearate, silver oleate, silver laurate, silver hydroxystearate, silver caprate, silver myristate and silver palmitate.

The silver compounds act as an oxidizing agent and therefore must be used in combination with one or more conventional reducing agents that can reduced silver (I) ion to metallic silver. A wide range of reducing agents are known for this purpose including, but not limited to, phenidone, hydroquinones, catechol, hindered bisphenols, amidoximes, hydrazides, ascorbic acid (and derivatives) and other classes of materials described for example in U.S. Pat. No. 5,939,249 (noted above).

The catalysts (or catalyst precursors) used with the noted silver compounds and reducing agents are metal or metal binary nuclei as described below.

Non-Silver Imaging Systems:

Similar to the silver compounds described above, a number of other metal compounds can act as oxidizing agents in thermal imaging. Such compounds include salts or complexes of copper (II), nickel (II), manganese (II) or (III), iron (II) or (III) and any other metal ion that can be reduced in the presence of the noted reducing agents. The metals are generally complexed with pyrophosphates, alkanolamines, carboxylic acids, organic amines, alkoxides, aryloxides, sulfur ligands such as thiolates, xanthates, dithiocarbamates, dithiophosphates or dithiophosphinates, and organophosphines such as triphenylphosphine and tri(p-tolyl) phosphine. Illustrative of such thermally developed non-silver elements are the copper physical developers described in *Research Disclosure*, 162, 19–20 (1977).

Reducing agents useful in this imaging system include amine boranes such as diethylamine borane, triethylamine borane and pyridine borane, borohydrides such as $R'[BH_4]$ wherein R' is a cation such as sodium, potassium, tetraethylammonium or tetraphenylphosphate, $NaBH_3CN$, $Na_2B_{10}H_{10}$, hydrazine and substituted hydrazine derivatives, sodium hypophosphite, sodium sulfite and organic reducing agents that are well known in the photographic art.

Examples of other heavy metal salt oxidizing agents are gold stearate, mercury behenate and gold behenate.

Catalysts useful in this imaging system include the metal nuclei described below as well as binary compounds such as sulfides and phosphides (such as $Cu_3P$, $CuP_2$, NiP, NiB, CoB, NiS, CuS, PdS and PtS).

More details about such imaging components are provided for example in U.S. Pat. No. 3,935,013 (Lelental), Lelental, *J. Electrochem. Soc.*, 122(4), 1975, pp. 486–490, Lelental, *J. Catal.* 32(3), 1974, pages 429–433, and Lelental, *J. Electrochem. Soc.*, 120(12), 1973, pages 1650–1654, U.S. Pat. No. 3,607,351 (Lee), U.S. Pat. No. 3,650,803 (Lin), U.S. Pat. No. 3,658,661 (Minklei), Bartholomew et al, *Applied Catalysis*, 4, 19–29 (1982) and Uken et al, *Catal.*, 65 402–415 (1980), all incorporated herein by reference.

Dye Physical Developer Imaging Systems:

A dye precursor (such as a leuco dye) that is reducible or oxidizable can be used as part of the imaging chemistry in combination with a is reducing agent or oxidizing agent, depending upon the nature of the dye precursor. Examples of such compounds are reducible tetrazolium salts and leucophthalocyanines that can be incorporated into the thermally imageable elements of this invention in combination with a suitable reducing agent and catalyst (or catalyst precursor). Upon thermal imaging, the imaging chemistry provides the corresponding dye (such as a formazan or phthalocyanine dye)

Useful reducing agents for this system include amine boranes, phosphine boranes, hydrazine (and its derivatives), sodium hypophosphites and borohydrides.

Useful catalysts (or catalyst precursors) include the metal nuclei described below and the binary compounds noted above.

Additional details of this image chemistry can be found in U.S. Pat. No. 4,046,569 (Gysling et al), U.S. Pat. No. 4,042,392 (Gysling et al), Lelental et al, *J. Photogr. Sci.*, 26(4), 1978, pp. 135–43 and Lelental et al, *J. Photogr. Sci.* 32(1), 1984, pp. 1–7, all incorporated herein by reference.

Leuco Dye Imaging Systems:

In another embodiment of this invention, redox amplification chemistry containing an oxidizable leuco dye in combination with an oxidizing agent, such as a peroxide can be useful. Useful oxidizable leuco dyes include those of the triaryl methine class, including, for example Leucomalachite Green, Leuco Crystal Violet, and Leucoberberlin Blue.

Peroxides useful in this imaging system include hydrogen peroxide and organic peroxides such as those described in Brown, *J. Org. Chem.*, 41, 3756, 1976, Bailey, *J. Amer. Chem. Soc.* 78, 3811, 1956 and Erickson, *Organic Syntheses, Collect. Vol. V*, Wiley, N.Y., 489 and 493 (1973). Other oxidizable leuco dyes and oxidizing agents known to those skilled in then art can also be used in this embodiment.

Catalysts (or catalyst precursors) useful in this imaging system include the metal and metal binary (for example metal sulfides, selenides, tellurides, phosphides and borides) nuclei described below as well as various metal ions such as Mn (II), Co(II) and Fe(II). Mn(II), for example, is a useful catalyst for peroxide oxidation as described in U.S. Pat. No. 4,057,427(Enriquez et al), *Research Disclosure*, 15,960, July 1977, page 58 and CA 907,388 (AGFA). In an embodiment of this invention, Mn(II) or other useful metal ions, that can function as homogeneous catalysts for such oxidation reactions, are released from microcapsules containing these ions upon imagewise thermally addressing an imaging element containing such microencapsulated metal ions and a redox couple comprising a peroxide oxidant and an oxidizable leuco dye.

Peroxide Development Imaging Systems:

Another image-forming chemistry can include what is known in the photographic art as a color developing agent, and a peroxide (either hydrogen peroxide or an organic peroxide). Color developing agents are compounds that, in oxidized form, will react with what are known in the art as dye forming color couplers. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957 (noted above.

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

Peroxides useful in this imaging system include hydrogen peroxide and organic peroxides such as those described in Brown, *J. Org. Chem.*, 41, 3756, 1976, Bailey, *J. Amer. Chem. Soc.* 78, 3811, 1956 and Erickson, *Organic Syntheses, Collect. Vol. V*, Wiley, N.Y., pages 489 and 493 (1973).

Catalysts (or catalyst precursors) useful in this imaging system include the metal and metal binary (for example sulfides, selenides, tellurides, phosphides and borides) nuclei described below as well as various metal ions such as Mn (II), Co(II) and Fe(II).

Tellurium Imaging Systems:

The preferred embodiments of the present invention include a tellurium compound or a metalloborane compound with or without a suitable reducing agent and metal nuclei catalyst or catalyst precursor. Some tellurium compounds undergo catalytic thermal reduction to metallic tellurium without the need for a separately incorporated reducing agent if the tellurium compound includes an internal reducing ligand. Such compounds function as "molecular physical developers".

The more preferred embodiments of this invention incorporate a tellurium (II) or tellurium (IV) compound with a separate reducing agent and metal nuclei catalyst (or catalyst precursor) to provide a visible image upon heating.

A range of tellurium (IV) compounds is useful as oxidizing agents. Selection of an optimum tellurium (IV) compound depends on such factors as processing (heating) conditions, desired image tone, and other components of the imaging material. Especially useful tellurium (IV) compounds are organotellurium (IV) compounds of the general formula:

$$R_nTeX_{4-n} \quad (I)$$

wherein R is independently, in each occurrence, a substituted or unsubstituted alkyl, substituted or unsubstituted aryl or substituted or unsubstituted acyl group, X is a halide, pseudohalide or carboxylate, and n is 1 to 4.

The halides of X include Cl, Br and I. Pseudohalides include ligands functionally similar to halides, such as OCN, SCN, SeCN, TeCN or $N_3$. Typical carboxylates include $O_2CCH_3$ (acetyloxy), $O_2CCF_3$ (trifluoroacctyloxy) and $O_2CPh$ (benzoyloxy). Ph in all occurrences in this application designates substituted or unsubstituted phenyl. R includes, but is not limited to, substituted and unsubstituted alkyl groups (preferably those containing from 1 to 10 carbon atoms), substituted and unsubstituted aryl groups (preferably containing from 6 to 10 carbon atoms, such as phenyl and naphthyl), and substituted and unsubstituted acyl groups, preferably containing from 1 to 11 carbon atoms, such as formyl, acetyl, propanoyl, butanoyl, benzoyl, α or β-naphthoyl, acetylacetonato, or the like).

In one particularly preferred form the formula 1 compound is $$TeX_2(R)_2 \quad \text{(II)}$$

wherein X is Cl or Br, R is and alkyl or aryl group as defined above or $CH_2C(O)Ar$, or $(R)_2$ (both occurrences of R taken together) is $—CH_2C(O)CR^1R^2C(O)CH_2—$. Ar is preferably phenyl, p-anisyl or o-anisyl. $R^1$ and $R^2$ are preferably hydrogen or methyl.

Useful compounds of this type include $Te(p\text{-}CH_3O—C_6H_4)_3Cl$ $Te(C_6H_4\text{-}p\text{-}OCH_3)_2Cl_2$ $TeCl_2[CH_2C(O)\text{-}o\text{-}CH_3O—C_6H_4]_2$ $TeCl_2[CH_2C(O)\text{-}p\text{-}CH_3O—C_6H_4]_2$ $TeCl_2[CH_2C(O)—C_6H_5]_2$ $TeBr_2[CH_2C_6H_5]_2$ $Cl_2Te[CH_2C(O)C(CH_3)_2C(O)CH_2]$ and $Cl_2Te[CH_2C(O)CH_2C(O)CH_2]$.

The described complexes of tellurium (IV) generally have a coordination number of four although compounds containing an organic group R that is functionalized with one or more Lewis base substituents may have coordination numbers greater than 4 [for example the organotellurium (IV) chelate, $TeCl_3$(2,6-diacetylpyridine-C,N,O] that has a coordination number of 6, as taught in U.S. Pat. No. 4,239,846 (Gysling et al) and in Gysling et al, *J. Organometal. Chem.*, 184, 417(1980).

The term organotellurium (IV) compound as used herein is intended to include any type of bonding or complexing mechanism which enables the resulting material to provide oxidizing agent properties and the described oxidation-reduction image precursor combination when included in a polymeric matrix with a reducing agent, such as an organic reducing agent. In some instances the exact bonding of the described tellurium (IV) compound is not fully understood. Accordingly, the term "compound" is intended to include salts and other forms of bonding in the desired oxidation-reduction image precursor combination. The term organotellurium compound also is intended to include neutral complexes or salts of non-neutral complexes.

Useful organotellurium (IV) compounds are described, for instance, in Irgolic, *The Organic Chemistry of Tellurium*, Gordon and Breach Science Publishers, N.Y., N.Y., 1974 and Irgolic, *J. Organometal. Chem*, 103 91(1975), 130, 411(1977), 158, 267(1978), 189, 65(1980), 203, 367(1980), *The Chemistry of Organic Selenium and Tellurium Compounds*, Vol. 1 (1986) and Vol. 2 (1987), Patai and Rappoport (Eds.), Wiley, N.Y., and Irgolic, *Organotellurium Compounds* in *Methods of Organic Chemistry* (Houben-Weyl), Vol. E12b, D. Klamann (Ed), Georg Thieme, Verlag, N.Y., 1990.

The selection of an optimum organotellurium (IV) compound for an imaging element of this invention will depend upon such factors as the particular reducing agent in the imaging material, processing conditions, desired image, and the like.

Especially useful organotellurium (IV) oxidizing agents include $TeX_2(CH_2C_6H_5)_2$ (wherein X is Cl, Br, I or acetyloxy), $TeCl_2[H2C(O)Ar]_2$ (wherein Ar is phenyl, p-anisyl or o-anisyl), and $TeX_2[CH_2C(O)CR^1R^2C(O)CH_2]$ [wherein X is halide, pseudohalide or carboxylate as described above, and $R^1$ and $R^2$ are H, alkyl (such as methyl) or aryl].

If desired, the described organotellurium (IV) compounds can be prepared in situ in the thermally imageable clement of the invention. However, due to the better control achieved by preparation of the organotellurium compound separate from other components of the described elements, it is usually desirable to prepare the organotellurium (IV) compounds ex situ, that is, separate from other components of the described compositions. The organotellurium compounds then can be mixed with other components of the elements as desired.

Tellurium (II) coordination compounds containing 1,1-dithio ligands are also useful as oxidants in this invention. Such compounds include, but are not limited to, those having the following formula:

$$Te(S_2X)_2$$

wherein X is COR (xanthates, and R is an alkyl or aryl group as defined above), $CNR_2$ (ditihocarbamates, and R is an alkyl or aryl group as defined above), $RP_2$ (dithiophosphinates, and R is an alkyl or aryl group as defined above), or CR (dithiocarboxylates, and R is an alkyl or aryl group as defined above).

These and other useful Te(II) compounds have been described for example in Lelental et al, *J. Photogr. Sci.* 28 109–218 (1980), Gysling et al, *J. Photogr. Sci.*, 30, 55–65 (1982), Haiduc et al, *Chem. Rev.*, 94, 301–326 (1994), U.S. Pat. No. 4,251,623 (Gysling), and U.S. Pat. No. 4,152,155 (Lelental et al).

Reducing Agents

The elements of this invention can comprise a variety of reducing agents. These reducing agents can be organic reducing agents, inorganic reducing agents or combinations of both, with organic reducing agents being preferred. Reducing agents that are especially useful are typically silver halide developing agents. Examples of useful reducing agents include, but are not limited to, phenolic reducing agents (such as polyhydroxybenzenes, including, for instance, hydroquinone, alkyl-substituted hydroquinones, including tertiary butyl hydroquinone, methyl hydroquinone, 2,5-dimethylhydroquinone and 2,6-dimethylhydroquinone; catechols and pyrogallols; chloro-substituted hydroquinones, such as chlorohydroquinone or dichlorohydroquinone; alkoxy-substituted hydroquinones, such as methoxyhydroquinone or ethoxyhydroquinone; aminophenol reducing agents such as 2,4-diaminophenols and methylaminophenols) ascorbic acid reducing agents (such as ascorbic acid, ascorbic acid ketals and ascorbic acid derivatives), hydroxylamine reducing agents, 3-pyrazolidone reducing agents (such as 1-phenyl-3-pyrazolidone and 4-methyl-4-hydroxymethyl 1-phenyl-3-pyrazolidone), reductone reducing agents (such as 2-hydroxy-5-methyl-3-piperidino-2-cyclopenitenone), sulfonamidophenol reducing agents such as described those in *Research Disclosure*, January 1973, pages 16–21 and others readily apparent to one skilled in the art. Inorganic reducing agents can include borane type reductants such as $LBH_3$ where L=an amine or organophosphine (for example $PPh_3BH_3$, $Me_2NHBH_3$, $Me_3NBH_3$, $Et_3NBH_3$, and pyridine$BH_3$) as, for example, described in Lane, *Aldrichimica Acta*, 6, 51–58 (1973) and WO 97/49841 A1 (Corella et al), and hydroborate salts, including and $BH_4^-$ salts such as $KBH_4$, $Et_4NBH_4$ and $\{(PPh_3)_2N\}BH_4$ and $K[B_3H_8]$, $Cs[B_9H_{14}]$, $Na_2[B_{10}H_{10}]$, and related hydroborate salts as described in Kane et al, *J. Amer. Chem Soc.*, 92, 2571–2 (1970), U.S. Pat. No. 3,406,019 (Muetterties), Klanberg et al, *Inorg. Chem.*, 7, 2272–8 (1968), and Klanberg et al, *J. Inorg. Synth.*, 11, 24–33 (1968). Useful inorganic reducing agents also include, for example, those described in U.S. Pat. No. 3,598,587 (Yudelson et al). Combinations of reducing agents can be employed, if desired. Selection of an optimum reducing agent or reducing agent combination will depend upon such factors as thermal exposure conditions, desired image, the nature of the tellurium oxidant as well as the other components of the thermally imageable element.

A broad range of concentrations of the reducing agents is useful in the elements of the invention. The optimum concentration will depend upon such factors as the particular composition, exposure conditions, desired image, and the like. Typically a concentration of from about 0.01 to about 10 moles of reducing agent per mole of organotellurium (IV) oxidizing agent is employed in the element, preferably a concentration of from about 0.1 to about 5 moles of reducing agent per mole of described oxidizing agent is used. A typical concentration of described reducing agent is, in a typical element of this invention, from about 0.01 to about 500 mg/dm$^2$. An especially useful concentration range of described reducing agent is from about 0.1 to about 200 mg/dm$^2$.

Catalysts and Catalyst Precursors

The elements of this invention must include a catalyst or catalyst precursor of some type. For example, one or more metal-containing catalytically active particles or metal nuclei or their chemical precursors can be used. The catalyst providing component can be any metal, metal binary compound or metal salt or complex that functions as the desired development catalyst, or provides the desired developable nuclei by means of some thermal and/or chemical transformation of a catalyst precursor upon imagewise thermal exposure. The concentration of catalyst component can be from about 0.0001 to about 1.0 mole of metal compound per mole of oxidizing agent in the oxidation-reduction image-forming combination, with the preferred range being from about 0.001 to about 0.1 mole per mole of oxidant.

It is believed that the metal nuclei decrease the activation energy and increase the reaction rate and act as catalysts, for example in the image precursor chemistry containing the organotellurium (IV) compound and reducing agent in the thermally imageable elements of the invention. It is believed that the operation of such a catalytic reaction enables a shorter exposure time and/or a lower exposure temperature for amplification of the nuclei in areas of the element that have been thermally addressed than otherwise would be possible using, for example, conventional dry silver thermographic imaging elements that do not incorporate a catalyst or catalyst precursor in their formulations.

Palladium metal nuclei are preferred catalysts for this invention since they provide physical development sites that promote formation of the metal and $Te^0$ images. Other nuclei for promoting physical development can alternatively be employed as catalysts. Such nuclei include chromium, iron, cobalt, nickel, copper, cadmium, selenium, silver, tin, tellurium, iridium, ruthenium, rhenium, platinum, rhodium, gold and lead nuclei. Copper, tellurium, palladium, platinum, rhodium, iridium, gold and silver are preferred. The nuclei can be metallic form or present as metal binary compounds, such as phosphides, sulfides, selenides, tellurides, oxides or the like. The palladium catalyst can be incorporated in the element as preformed metal nuclei or the nuclei can be provided from any convenient precursor source, such as compounds that are decomposable through various means to the desired metal nuclei. Such compounds include, but are not limited to, $K_2Pd(C_2O_4)_2$, $PdCl_2$, $K_3Co(C_2O_4)_3$, $K_2(MCl_4)$ wherein M is Pd or Pt, $[Et_4N]_2MCl_4$ wherein M is Pd or Pt, $M(PR_3)_2Cl_2$ wherein M is Pd or Pt, R is alkyl or aryl, $M(acac)_2(CO)_2$ wherein M is Rh or Ir, "acac" is acetylacetonate; $[Co(NH_3)_5N_3]Cl_2$, $Se(S_2CO\text{-iso-}C_3H_7)_2$, $Te[S_2P(OCH_3)_2]_2$, $K_2Pt[(C_2O_4)_2]$, $Pd[P(C_6H_5)_3]_2(C_2O_4)$, $\{Cu[P(OCH_3)_3]_4\}B(C_6H_5)_4$, $\{Cu[P(OCH_3)_3]_2BH_3CN\}_2$, $Cu[Sb(C_6H_5)_3]_3Cl$ and $[Cu(\text{ethylenediamine})_2][B(C_6H_5)_4]_2$. Other useful Pd complexes are described in U.S. Pat. No. 3,719,490 (Yudelson et al), U.S. Pat. No. 4,287,354 (Gysling) and U.S. Pat. No. 4,258,138 (Gysling), and *Research Disclosure*, Item 13705, September 1975. Other useful Cu complexes are described in U.S. Pat. No. 3,859,092 (Gysling et al) and U.S. Pat. No. 3,860,501 (Gysling), U.S. Pat. No. 3,880,724 (Gysling), U.S. Pat. No. 3,9237,055 (Gysling), and Barnard et al, *Palladium in Comprehensive Coordination Chemistry*, Vol. 5, pp. 1099–1129, G. Wilkinson, Gillard, and McCleverty (Eds.), Pergamon Press, New York, 1987, all of the disclosures of which are incorporated herein by reference.

Binary combinations of these metals are also efficient initiators or accelerators for the amplification chemistries of this invention because of their high degree of catalytic activity. Other metal containing catalytically active compounds or catalyst precursors that enhance the thermal sensitivity of the imaging elements are also useful for forming images according to the invention. Other metal compounds that provide catalytic nuclei that are useful include chromium, iron, cobalt, nickel, copper, selenium, palladium, silver, tin, tellurium, iridium, ruthenium, rhenium, platinum, rhodium and gold compounds and combinations of these compounds.

In another embodiment of this invention a catalyst precursor, such as $Pd(acac)_2$ or other reducible metal compound, is uniformly coated with a thermal base releasing compound, a pH sensitive reducing agents, and an image-forming redox couple. Upon imagewise thermally addressing this element, the pH sensitive reducing agent is activated to reduce the Pd(II) compound to elemental Pd metal by the thermally released base, and the resulting Pd metal acts as a catalyst for the incorporated redox image forming chemistry.

In still another embodiment, the metal catalyst precursor, for example a Pd(II) or Pt(II) compound, is spontaneously reduced to the elemental metal by the reducing agent of the image forming redox couple at the elevated temperature used to thermally address the image element.

Other Addenda

The elements of the invention can contain development modifiers that function as speed-increasing compounds, hardeners, antistatic layers, plasticizers and lubricants, coating aids, typical examples of which are described in *Research Disclosure*, Vol. 389, September 1996, Item 38957. Preferably physical (particularly surface) property modifying addenda are coated in the overcoat. *Research Disclosure* (previously *Product Licensing Index*) is published by Kenneth Mason Publications, Ltd., Dudley House, 12 North St., Emsworth, Hampshire P010 7DQ England.

The thermally imageable elements of this invention can contain either organic or inorganic matting agents. Examples of organic matting agents are particles, often in the form of beads, of polymers such as polymeric esters of acrylic and methacrylic acid, for example poly(methylmethacrylate), styrene polymers and copolymers, and the like. Examples of inorganic matting agents are particles of glass, silicon dioxide titanium dioxide, magnesium oxide, aluminum oxide, barium sulfate, calcium carbonate, and the like. Matting agents and the way they are used are further described in U.S. Pat. Nos. 3,411,907 and 3,754,924.

The concentration of matting agent required to give the desired roughness depends on the mean diameter of the particles and the amount of binder. Preferred particles are those having a mean diameter of from about 1 to about 15 μm, and preferably from about 2 to about 8 μm. The matte particles can be usefully employed at a concentration of about 1 to about 100 milligrams per square meter.

Binders & Supports

The elements of the invention can contain various colloids and polymers alone or in combination as vehicles, binding agents, and in various layers. Suitable materials can be hydrophobic or hydrophilic. They are transparent or translucent and include both naturally occurring substances (such as proteins, gelatin, gelatin derivatives, cellulose derivatives), polysaccharides (such as dextrin and gum arabic) and synthetic polymeric substances [such as water-soluble polyvinyl compounds like poly(vinyl pyrrolidone), acrylamide polymers and others readily apparent to one skilled in the art]. Other synthetic polymeric compounds that can be employed include dispersed vinyl compounds such as in latex form and particularly those that increase dimensional stability of photographic materials. Effective polymers include water-insoluble polymers of alkyl acrylates and methacrylates acrylic acid, sulfoalkyl acrylates, methacrylates, and those that have crosslinking sites that facilitate hardening or curing. Especially useful materials are high molecular weight materials and resins which are compatible with the described tellurium complexes, including poly(vinyl butyral), cellulose acetate butyrate, poly (methyl methacrylate), poly(vinyl pyrrolidone), ethylcellulose, polystyrene, poly(vinyl chloride), polyisobutylene, butadiene-sty-rene copolymers, vinyl chloride-vinyl acetate copolymers, copolymers of vinyl acetate, vinyl chloride and maleic acid, and poly(vinyl alcohol). Combinations of the described colloids and polymers can also be used.

The elements of the invention can also comprise a variety of supports that can tolerate the exposure temperatures employed according to the invention. The support can be transparent (either tinted or colorless) or reflective (typically white). Any of the supports for conventional photothermographic elements can be employed in constructing the catalytic thermographic elements of the invention. Since the thermographic elements receive heat for comparatively short time intervals and limited to discrete image areas, rather than over the longer time periods and entire element area (as in photothermography) it is possible to employ a still wider range of supports, including those employed in photographic elements intended for aqueous solution processing. Thermally stable rigid supports, such as glass and metal supports are specifically contemplated. In preferred form the supports are flexible supports, such as paper or film supports. The supports can be chosen from among photothermographic film supports specifically constructed to be resistant to dimensional change at elevated temperatures, although such support selections are not required. Such supports can be comprised of linear condensation polymers that have glass transition temperatures above 190° C., and preferably above 220° C., such as polycarbonates, polycarboxylic esters, polyamides, polysulfonamides, polyethers, polyimides, polysulfonates and copolymer variants, as described in U.S. Pat. No. 3,634,089 (Hamb), U.S. Pat. No. 3,772,405 (Hamb), U.S. Pat. No. 3,725,070 (Hamb et al) and U.S. Pat. No. 3,793,249 (Hamb et al), Wilson *Research Disclosure*, Vol. 118, February, 1974, Item 11833, and Vol. 120, April, 1974, Item 12046, Conklin et al *Research Disclosure*, Vol. 120, April, 1974, Item 12012, *Product Licensing Index*, Vol. 92, December, 1971, Items 9205 and 9207, *Research Disclosure*, Vol. 101, September, 1972, Items 10119 and 10148, *Research Disclosure*, Vol. 106, February, 1973, Item 10613; *Research Disclosure*, Vol. 117, January, 1974, Item 11709, and *Research Disclosure*, Vol. 134, June, 1975, Item 13455. Under the conditions of thermal imaging contemplated herein the supports described in *Research Disclosure*, Item 38957, XV Supports employed for silver halide photographic films and paper can be selected.

Layer Arrangements

It is usually simplest to coat the image-forming chemistry and the binder in a single layer, although multiple layers are possible, provided the catalyst (or catalyst precursor) and image-forming chemistry combination remains in reactive association upon thermally addressing the imaging element. It is, in some cases, useful to coat a protective overcoat layer over the layer or layers containing the image-forming chemistry. The protective overcoat provides physical protection, for example from fingerprinting and abrasion marks. The overcoat layer can, in its simplest form, consist of one of the polymers described above as binders. However, any other polymeric material can be employed alone or in combination as an overcoat binder that is compatible with the imaging layer(s) and can tolerate the exposure temperatures contemplated for imaging.

The components of the thermally imageable element can be in any location in the element that provides the desired image. If desired, one or more of the components can be in more than one layer of the element. For example, in some cases, it is desirable to include certain percentages of the reducing agent, toner, stabilizer and/or other addenda in an overcoat layer. This, in some cases, can reduce migration of certain addenda in the layers of the element. The thermographic imaging element of the invention can contain a transparent, image insensitive protective layer. The protective layer can be an overcoat layer that is a layer that is on the opposite side of the support from the image sensitive layer(s). The imaging element can contain both a protective overcoat layer and a protective backing layer if desired. An adhesive interlayer can be imposed between the imaging layer that is on the opposite side of the support from the image sensitive layer(s). The imaging element can contain both a protective overcoat layer and a protective backing layer, if desired. An adhesive interlayer can be imposed between the imaging layer and the protective layer and/or between the support and the backing layer. The protective layer is not necessarily the outermost layer of the imaging element. The protective overcoat layer preferably acts as a barrier layer that not only protects the imaging layer from physical damage, but also prevents loss of components from the imageable layer. The overcoat layer preferably comprises a film forming binder, more preferably a hydrophilic film forming binder. Such binders include, for example, crosslinked polyvinyl alcohol, gelatin, poly(silicic acid), and the like. Particularly preferred are binders comprising poly (silicic acid) alone or in combination with a water-soluble hydroxyl-containing monomer or polymer as described in U.S. Pat. No. 4,828,971, the disclosure of which is incorporated herein by reference.

The thermally imageable element of this invention can also include a backing layer. The backing layer is an outermost layer located on the side of the support opposite to the imaging layer. It is typically comprised of a binder and a matting agent that is dispersed in the binder in an amount sufficient to provide the desired surface roughness and the desired antistatic properties. The backing layer should not adversely affect sensitometric characteristics of the thermographic element such as minimum density, maximum density and photographic speed. The element preferably contains a slipping layer to prevent it from sticking as it passes under the thermal print head. The slipping layer comprises a lubricant dispersed or dissolved in a polymeric binder. Lubricants that can be used include, but are not limited to:

(1) A poly(vinyl stearate), poly(caprolactone) or a straight chain alkyl or polyethylene oxide perfluoroalkylated ester or perfluoroalkylated ether as described in U.S. Pat. No. 4,717,711, the disclosure of which is incorporated by reference.

(2) A polyethylene glycol having a number average molecular weight of about 6000 or above, or fatty acid esters of polyvinyl alcohol, as described in U.S. Pat. No. 4,717,712 the disclosure of which is incorporated herein by reference.

(3) a partially esterified phosphate ester and a silicone polymer comprising units of a linear or branched alkyl or aryl siloxane as described in U.S. Pat. No. 4,737,485, the disclosure of which is incorporated herein by reference.

(4) A linear or branched aminoalkyl-terminated poly (dialkyl, diaryl or alkylaryl siloxane), such as an aminopropyidimethylsiloxane or a T-structure polydimethylsiloxane with an aminoalkyl functionality at the branch-point, as described in U.S. Pat. No. 4,738,950, the disclosure of which is incorporated herein by reference.

(5) Solid lubricant particles, such as poly (tetrafluoroethylene), poly(hexafluoropropylene), or poly(methylsilylsesquioxane, as described in U.S. Pat. No. 4,829,050, the disclosure of which is incorporated herein by reference.

(6) Micron ($\mu$m) size polyethylene particles or micronized polytetrafluoroethylene powder as described in U.S. Pat. No. 4,829,860, the disclosure of which is incorporated herein by reference.

(7) A homogeneous layer of a particulate ester wax comprising an ester of a fatty acid having at least 10 carbon atoms and a monohydric alcohol having at least 6 carbon atoms, the ester wax having a particle size of from about 0.5 $\mu$m to about 20 $\mu$m, as described in U.S. Pat. No. 4,916,112, the disclosure of which is incorporated herein by reference.

(8) A phosphoric acid or salt as described in U.S. Pat. No. 5,162,292, the disclosure of which is incorporated herein by reference.

(9) A polyimide-siloxane copolymer, the polysiloxane component comprising more than 3 weight % of the copolymer and the polysiloxane component having a molecular weight of greater than 3900.

(10) A poly(aryl ester, aryl amide)-siloxane copolymer, the polysiloxane component comprising more than 3 weight % of the copolymer and the polysiloxane component having a molecular weight of at least about 1500.

The imaging element can also contain an electroconductive layer that, in accordance with U.S. Pat. No. 5,310,640, is an inner layer that can be located on either side of said support. The electroconductive layer preferably has an internal resistivity of less than $5\times10^{11}$ ohms/square.

The protective overcoat layer and/or the slipping layer may be electrically conductive, having a surface resistivity of less than $5\times10^{11}$ ohms/square. Such electrically conductive overcoat layers are described in U.S. Pat. No. 5,547,821, herein incorporated by reference. As taught in U.S. Pat. No. 5,137,802, electrically conductive overcoat layers comprise metal-containing particles dispersed in a polymeric binder in an amount sufficient to provide the desired surface conductivity. Examples of suitable electrically-conductive metal-containing particles for the purposes of this invention include:

1) Donor-doped metal oxide, metal oxides containing oxygen deficiencies, and conductive nitrides, carbides and borides. Specific examples of particularly useful particles include conductive $TiO_2$, $SnO_2$, $V_2O_5$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC. Examples of the many patents describing these electrically-conductive particles include U.S. Pat. Nos. 4,275,103, 4,394,441, 4,416,963, 4,418,141, 4,431,764, 4,495,276, 4,571,361, 4,999,276 and 5,122,445.

2) Semiconductive metal salts such as cuprous iodide, as described in U.S. Pat. Nos. 3,245,833, 3,428,451 and 5,075,171.

3) A colloidal gel of vanadium pentoxide as described in U.S. Pat. Nos. 4,203,769, 5,006,451, 5,221,598 and 5,284,714.

4) Fibrous conductive powders comprising, for example, antimony-doped tin oxide coated onto non conductive potassium titanate whiskers as described in U.S. Pat. No. 4,845,369 and U.S. Pat. No. 5,116,666. The components of the imaging chemistries described herein can be incorporated in the same or adjacent layers (as noted above), and they can also be arranged so that individual components are physically kept separated until thermal imaging. For example, components could be in two different layers and separated by a "barrier" layer that allows good keeping properties of the imaging element under ambient storage conditions but diffusion of the separate components during thermal imaging. Barrier layer materials useful in this manner are those that break down during thermal imaging to allow diffusion of imaging chemistry form one layer to another.

Alternatively, the components of the imaging chemistry can be physically separated by encapsulating one or more of the components. Upon thermal imaging, the materials used for encapsulated break down, rupture or undergo an increase in the permeability of the encapsulated reagent(s) through the capsule wall, releasing the components for reaction. For example, the catalyst needed for the imaging chemistry could be encapsulated until thermal imaging provides its release. Vesicles or microcapsules useful for this purpose are well known for other nonanalogous applications including the release of drugs, pharmaceuticals, pesticides and other materials. Details about useful encapsulating materials are provided, for example, in EP-A-0 587,411, U.S. Pat. No. 4,084,967 (O'Brien), U.S. Pat. No. 5,741,592 (Lewis et al), EP-A-0 806 302 (Lorenz et al),), *Microencapsulation. Methods and Industrial Applications*, S. Benita (Ed.), Dekker, N.Y., 1996, and Sparks, et al, *Drug Manuf. Technol Ser.*, 3, 177–222 (1999).

Preferred Embodiments

It has been found, according to a preferred embodiment of the present invention, that an image can be provided in a catalytic thermographic imaging material comprising, in reactive association, (a) metal-containing catalytically active particles or catalyst precursor, and (b) an oxidation-reduction image-forming combination comprising: (i) an organotellurium (IV) compound as an oxidizing agent and (ii) a reducing agent, and (c) a binder. Tellurium (IV) indicates tellurium in a +4 oxidation state. A wide variety of organotellurium (IV) compounds are useful as oxidants in such thermographic elements. Such tellurium compounds are described by Raston et al, *J. Chem. Soc.* (*Dalton*), 2307(*1976*), *Irgolic, The Organic Chemistry of Tellurium*, Gordon and Breach, N.Y., 1974, and *The Organic Chemistry of Organic Selenium and Tellurium Compound*, Vol. 1 (1986) and Vol. 2 (1987), Patai and Rappoport (Eds.), Wiley, New York.

An important feature of the thermally imageable elements is that they enable an amplification factor as high as $10^8$ resulting from the catalytic nature of the reduction of the organotellurium (IV) compounds to elemental tellurium. Achieving high levels of amplification without employing a silver compound as an oxidizing agent constitutes a significant advantage of the invention. Other advantages flow from the simplicity of forming the thermographic materials, demonstrated below.

In one preferred embodiment, a thermally imageable element of the invention is comprised of a support having coated thereon in reactive association (a) metal containing catalytically active particles, (b) an oxidation-reduction image-forming combination comprising (i) a tellurium (IV) compound as an oxidizing agent, and (ii) a reducing agent, and (c) a binder.

A useful embodiment of the invention comprises a thermally imageable element comprising in reactive association (a) a catalytically active metal compound, typically $Pd^0$ nuclei, (b) an oxidation-reduction image-forming combination comprising: (i) a tellurium (IV) compound as an oxidizing agent, typically an organotellurium(IV) compound of the type described above in connection with formulae I and I and (ii) a reducing agent which is an organic reducing agent selected from the group consisting of sulfonamidophenol, ascorbic acid, 3-pyrazolidone, hydroquinone, reductone and aminophenol reducing agents and combinations thereof, and (c) a polymeric binder. It is desirable, in some cases, to employ an image stabilizer or an image stabilizer precursor (such as a thione) in the elements to improve post processing image stability. In some cases the tellurium (IV) complexes are sufficiently stable after processing that it is advantageous to forego the addition of a separate stabilizer.

Manufacture

The thermally imageable compositions described herein can be coated on the support by various coating procedures known in the photographic art, illustrated by *Research Disclosure*, Vol. 308, December 1989, Item 308119, XV. Coating and drying procedures. These procedures include dip coating, air-knife coating, curtain coating or extrusion coating using hoppers such as described in U.S. Pat. No. 2,681,294 (Beguin). It is common practice to coat two or more layers simultaneously, early teachings of which are provided in U.S. Pat. No. 2,761,791 (Russell) and GB-A-837,095, and subsequently in numerous patents listed in *Research Disclosure* Item 308119, XV, noted above. Imaging Methods Various imagewise thermal exposure means are useful in the method of the invention. The elements are typically sensitive to any exposure means by which thermal energy is imagewise transferred to them. Typically an element is exposed imagewise with an array of heating elements, although other sources of thermal energy are useful, such as lasers, electron beams and the like.

A visible image can be formed in the element after imagewise exposure within a short time. An image having a maximum reflection density of at least 1.0, and typically at least 1.5, and a transmission density of at least 1.0, and typically at least 2.0, can be provided according to the invention. For example, the element can be heated to a temperature of at least 75° C. (preferably at least 80° C.) until a desired image is formed, typically within about 5 milliseconds (preferably 10 milliseconds) to about 10 seconds. The maximum temperature can be whatever is practical and necessary. The element is optimally heated to a temperature of from about 100° to about 250° C. until the desired image is formed, such as within 15 milliseconds to 2 seconds. Differential heating from one pixel area to another produces a viewable image. No wet processing solutions or baths are required for image formation.

An especially useful embodiment of the invention is a process of forming an image in a thermally exposed, thermally imageable element comprising a support having thereon in reactive association (a) catalytic palladium or other noble metal nuclei, (b) an oxidation-reduction image forming combination comprising (i) an organotellurium(IV) compound of the formula $TeX_2R_2$, wherein R is —$CH_2Ph$, X is Cl or Br, R is $CH_2Ar$ (Ar=Ph, p-anisyl or o-anisyl), R is $CH_2C(O)Ar$ (wherein Ar is p-phenyl or o-anisyl) or $R_2$ is —$CH_2C(O)CR^1R^2C(O)CH_2$— (wherein $R^1$ and $R^2$ are hydrogen, alkyl or aryl, X is halide, pseudohalide or carboxylate), as the oxidizing agent (ii) a reducing agent, as described, and (c) a polymeric binder, comprising thermally exposing the element to from about 100° C. to about 250° C. for 15 milliseconds to 2 seconds.

The following specific embodiments are included for a further understanding of the invention. However, the invention is not to be construed as limited to these examples.

EXAMPLE

Element Construction

A catalytic thermographic imaging element was prepared by coating on a 100 μm poly(ethylene terephthalate) film support at a wet coating thickness of 150 μm a solution, prepared by combining the following 2 solutions:

(A) Eighty milligrams of the organotellurium (IV) compound, $Cl_2Te(CH_2COC_6HC_6H_4\text{-p-}OCH_3)_2$ [prepared by the condensation reaction of $TeCl_4$ with 2 equivalents of p-anisyl-$C(O)CH_3$ in refluxing methylene chloride as described in K. K. Verma and S. Garg, *Synth. React. Inorg. Met.-Org. Chem.*, 24, 647(1004)] and 80 mg of 1-phenyl-3-pyrazolidone (Aldrich) were dissolved in 10 ml of binder solution A, 5% by weight poly(vinyl butyral) polymeric binder (BUTVAR B-76™ Monsanto) in a mixture of dichloromethane and 1,1,2-trichloroethane (7:3 parts by weight).

(B) One half ml of a palladium metal colloidal dispersion containing 1.0 mg of palladium/ml in binder solution A. The palladium metal colloidal dispersion was prepared by combining 570 mg of palladium (II) acetylacetonate (Aldrich) dissolved in a 50 ml of binder solution A, 55 mg of dimethylamine borane reducing agent (Aldrich) dissolved in a 50 ml of binder solution A, and 100 ml of binder solution A.

The resulting thermally imageable element was dried at 43° C.

Evaluation

A sample of this thermally imageable element was imagewise exposed thermally using a thin film thermal head capable of concurrently addressing an entire line. The thermal head was placed in contact with a combination of the imaging element and a protective film of 6 μm thick polyester sheet. Contact of the thermal head with the protective film was maintained by an applied pressure of 313 g/cm$^2$.

The line-write time was 25 millisecond, divided into 255 increments corresponding to the pulse width. Energy per pulse was 0.085 Joule/$cm^2$ and individual picture elements were of a size corresponding to 300 dots per inch (254 cm) dot density. In other words, the thermal head applied 255 pulses in 25 milliseconds to the same area of the thermally imageable element. To map the sensitivity of the element as a function of energy applied, the process was repeated in different areas of the clement using a linearly increasing pattern of pulses ranging from 5 to 255 in 10 pulse increments. A negative tellurium image resulted.

Densities of the resulting image steps were measured with a Macbeth TD504™ densitometer. The thermographic response of the element is indicated by the sensitometric curve of FIG. 1. Only the highest pulse count that resulted in minimum optical density is plotted.

The invention has been described in detail with particular reference to preferred embodiments thereof, but it will be understood that variations and modifications can be effected within the spirit and scope of the invention.

We claim:

1. A thermally imageable element comprising a support having thereon one or more layers, said element further comprising:

image-forming chemistry that comprises i) image precursor chemistry comprising a reducible or oxidizable leuco dye, and an oxidizing or reducing agent, respectively, and ii) a metal catalyst or a catalyst precursor that upon imagewise heating is capable of promoting thermally induced image formation with said image precursor chemistry, said i) and ii) components being in reactive association and uniformly dispersed or dissolved within a binder in said one or more layers, said element capable of being thermally addressed to provide a visible image as a result of thermally induced catalytic transformation of said image-forming chemistry.

2. The element of claim 1 wherein said image precursor chemistry comprises: i) a reducible tetrazolium salt or a leucophthalocyanine as an oxidizing agent, a reducing agent therefor.

3. The element of claim 1 wherein all components of said image precursor chemistry are uniformly dispersed or dissolved in the same layer of said thermally imageable element.

4. The element of claim 1 wherein said thermally imageable element comprises at least two adjacent and contiguous layers, and each of said layers comprises at least one component of said image precursor chemistry.

5. The element of claim 1 wherein at least one component of said image precursor chemistry is encapsulated in a manner that said component is released upon heating.

6. The element of claim 1 comprising first, second and third layers, said first and third layers comprising at least one component of said image precursor chemistry, and said second layer acting as a barrier layer between said first and third layers to prevent diffusion of said components until heating, during which at least one of said components is released to come in contact with said other components.

7. A process of forming an image in the non-photosensitive thermally addressable imaging element of claim 6 comprising imagewise thermally addressing said element to a temperature of at least 80° C.

8. A process of forming an image comprising imagewise thermally addressing the thermally imageable element of claim 1 at a temperature of at least 75° C.

9. The element of claim 1 wherein said image precursor chemistry comprises an oxidizable leuco dye and a reducing agent that is an amine borane, phosphine borane, hydrazine, or sodium hypophosphite or borohydrides.

10. The element of claim 1 wherein said image precursor chemistry comprises an oxidizable leuco dye that is a triarylmethane and said oxidizing agent is a peroxide.

11. A non-photosensitive thermally addressable imaging element comprised of a support having thereon in reactive association i) an oxidation-reduction image-forming combination comprising:

a. a reducing agent and b. an oxidizing agent to produce a dye on reaction with the reducing agent, said reducing agent and oxidizing agent being separate compounds or components of the same compound, ii) a metal nuclei catalyst or catalyst precursor capable of promoting the oxidation-reduction reaction of a and b on heating, and iii) a binder wherein said oxidizing agent is comprised of a leuco dye.

12. The imaging element of claim 11 wherein said catalyst contains at least one of the metals copper, gold, silver, tellurium, selenium, bismuth, palladium, platinum, rhodium and iridium.

13. The imaging element of claim 11 wherein said catalyst is palladium.

14. The imaging element of claim 11 wherein said reducing agent is sulfonamidophenol, ascorbic acid,. 3-pyrazolidone, hydroquinone, reductone, aminophenol or a mixture of two or more of these reducing agents.

15. The imaging element of claim 11 comprising from about 0.01 to about 10 moles of oxidizing agent per mole of reducing agent.

16. The imaging element of claim 11 wherein said catalyst precursor is an organometallic or coordination compound containing at least one of the metals copper, gold, silver, tellurium, selenium, bismuth, palladium, platinum, rhodium and iridium.

17. The imaging element of claim 16 wherein said catalyst precursor is an organometallic or coordination compound containing palladium.

* * * * *